United States Patent [19]

Defosse

[11] 4,365,612

[45] Dec. 28, 1982

[54] DEVICE FOR PROPELLING AN INFLATED BALL BY MEANS OF AN ELASTIC IMPACT

[76] Inventor: Georges Defosse, Rue de Heuseux, 46, B 4511 Barchon, Belgium

[21] Appl. No.: 147,598

[22] Filed: May 7, 1980

[30] Foreign Application Priority Data

May 7, 1979 [EP] European Pat. Off. ..... 79200222

[51] Int. Cl.[3] ..... F41B 15/00

[52] U.S. Cl. ..... 124/54; 124/41 R; 124/50

[58] Field of Search ..... 124/17, 16, 41 R, 50, 124/49, 32, 80, 79, 54

[56] References Cited

U.S. PATENT DOCUMENTS

| | | | |
|---|---|---|---|
| 2,884,253 | 4/1959 | Rivero-Ferro . | |
| 3,310,311 | 3/1967 | Peeples . | |
| 4,122,822 | 10/1978 | Scheiwiller | 124/41 R X |

FOREIGN PATENT DOCUMENTS

| | | | |
|---|---|---|---|
| 16361 | 10/1980 | Austria | 124/79 |
| 850907 | 1/1977 | Belgium . | |
| 18444 | 11/1980 | Belgium | 124/16 |
| 1428824 | 12/1968 | Fed. Rep. of Germany . | |
| 1728166 | 3/1972 | Fed. Rep. of Germany . | |
| 2216947 | 11/1972 | Fed. Rep. of Germany . | |
| 2434716 | 2/1975 | Fed. Rep. of Germany . | |
| 2447797 | 4/1976 | Fed. Rep. of Germany . | |
| 2511149 | 9/1976 | Fed. Rep. of Germany . | |
| 2753120 | 6/1978 | Fed. Rep. of Germany | 124/16 |
| 2810260 | 9/1978 | Fed. Rep. of Germany . | |
| 1433452 | 2/1966 | France | 124/16 |

*Primary Examiner*—Richard C. Pinkham
*Assistant Examiner*—William R. Browne
*Attorney, Agent, or Firm*—Schwartz, Jeffery, Schwaab, Mack, Blumenthal & Koch

[57] ABSTRACT

Device for propelling an inflated ball by elastic impact, includes an electromagnet 1, a plunger core 3 drawn by the coil, an oscillating lever 7, and a mechanical linkage 5, which connects the plunger core 3 to oscillating lever 7.

The oscillating lever 7 is connected to a striking lever 13 which pivots around an axle 14 fixed to the free end of oscillating lever 7. Striking lever 13 is made up of two arms of unequal length. At the end of the excursion of oscillating lever 7, the shorter arm 15 of striking lever 13 strikes against stop 32 which stops arm 15 and contributes to the acceleration of the longer arm 16 of striking lever 13; the striking mass 17 attached at the end of striking lever 13 thus strikes the inflated ball 22 at maximum speed.

13 Claims, 8 Drawing Figures

DEVICE FOR PROPELLING AN INFLATED BALL BY MEANS OF AN ELASTIC IMPACT

BACKGROUND OF THE INVENTION

There are a number of patents for devices for propelling an inflated ball. These devices comprise an element for holding the inflated ball in a fixed position, a guideway with variable horizontal and vertical orientation, and mobile elements for propelling the ball. In these devices the propulsion is accomplished, for example, using springs, compressed air, rollers or pulleys rotating at high speed, or oscillating arms comprising a single piece driven by a spring or a rotating motor.

All these devices have disadvantages which greatly limit their use: the compressed air devices are very noisy; the spring devices have a low frequency of firing and a power which changes rapidly due to weakening of the spring; and the devices equipped with electric motors are weak, and they are very sophisticated, which makes them costly and difficult to maintain.

An oscillation arm which is long so as to attain the speed needed to propel a ball is fragile if it is of a light construction; and if it is of a stronger construction its mass is difficult to retard after striking the ball.

SUMMARY OF THE INVENTION

The present invention concerns a device for propelling an inflated ball by elastic impact, which invention has as its object a device of very great simplicity, having strength sufficient to withstand any test, capable of high firing frequency, having high repeatability of striking power and of striking precision, requiring practically no maintenance, requiring little installation space, easy to operate, and very safe to use.

The device according to the invention is characterized by an articulated arm in the form of an oscillating lever and a striking lever, with the axles of the two levers being parallel; and by a motor means comprising at least one electromagnetic coil, at least one plunger core actuated by said coil, and a mechanical linking element linking the plunger core to the articulated arm.

BRIEF DESCRIPTION OF THE DRAWINGS

A more complete understanding of the invention will be had from the detailed description below, reference being had to the accompanying drawings in which.

DETAILED DESCRIPTION OF THE PREFERRED EMBODIMENTS

Figure 1:
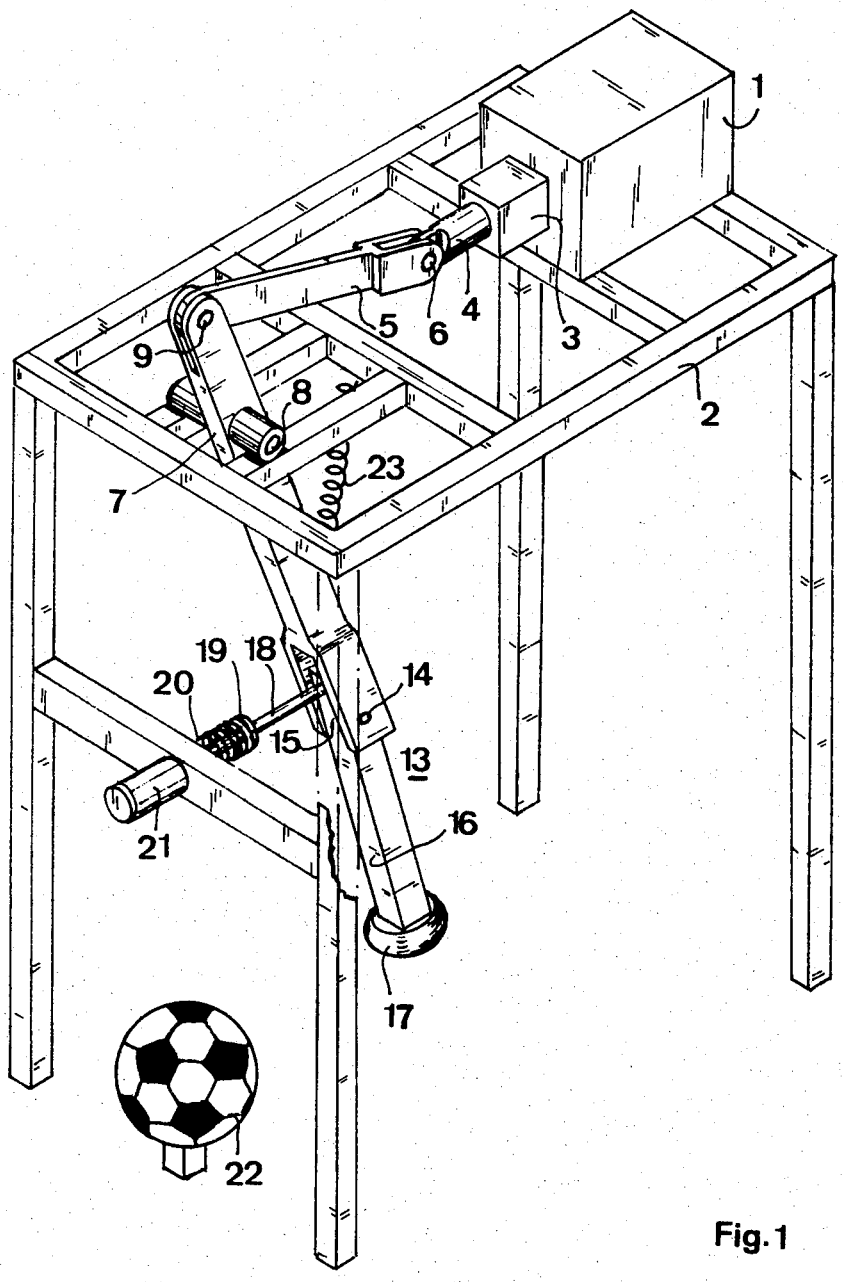
FIG. 1 is a first embodiment of a device according to the present invention.
Figure 2:
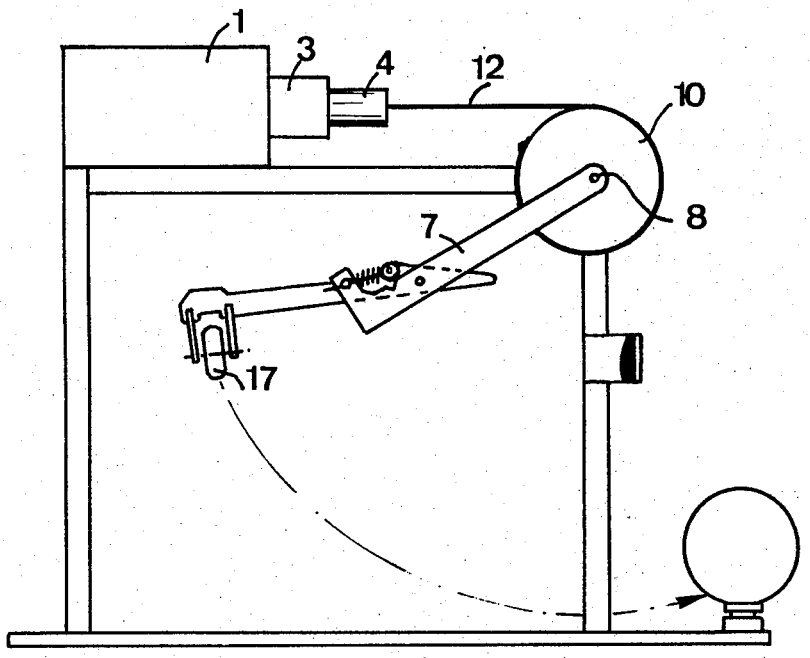
FIG. 2 is a side elevational view of a second embodiment according to the present invention.
Figure 3:
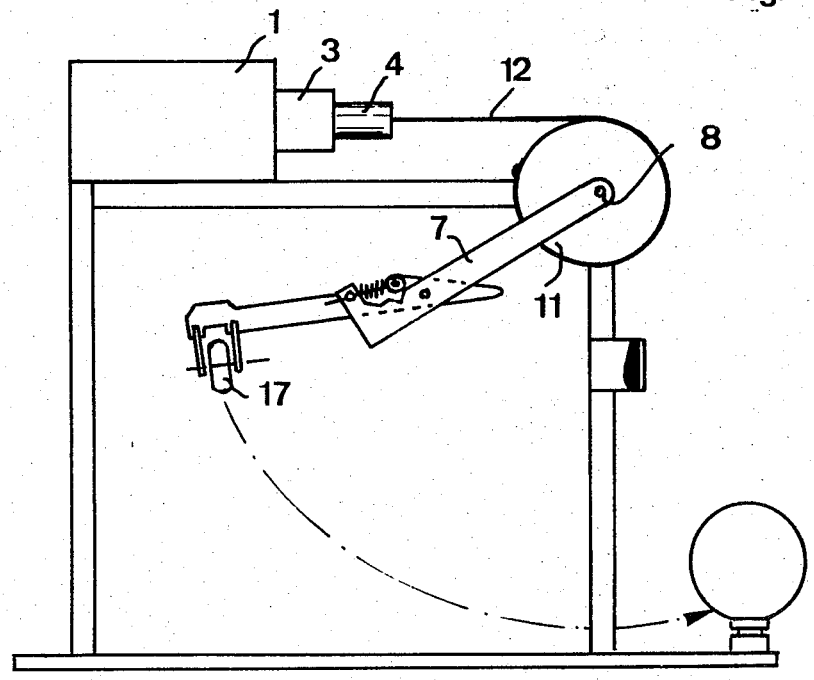
FIG. 3 is a side elevational view of a third embodiment according to the present invention.

In FIG. 1 the ball-propelling means comprises an electromagnetic coil 1 fixed to a frame 2; a plunger core 3 sliding in coil 1 and solidly attached to a rod 4; a connecting rod 5 with its head linked to rod 4 via pin 6; and a lever 7 oscillating around an axle 8 parallel to pin 6, with lever 7 linked to connecting rod 5 via a pin 9 which is parallel to axle 8 and pin 6. In a variant, connecting rod 5 may be replaced by another mechanical linking element, for example a pulley 10 (FIG. 2) or a cam of appropriate shape, 11 (FIG. 3), which is solidly attached to oscillating lever 7 and pivots around axle 8. The pulley 10 or cam 11 has a channel on its periphery, which channel guides a cable 12 connecting rod 4 to oscillating lever 7.

At the end of oscillating lever 7 a striking lever 13 is attached which pivots around an articulation axle 14 which is parallel to axle 8 and pins 6 and 9 and is itself located at the end of oscillating lever 7. Axle 14 in combination with striking lever 13 serves to create two arms of unequal size, the shorter being a drive arm 15 and the longer being the striking arm 16 which ends in a striking mass 17.

In this example embodiment there is an elastic stop means, comprising rod 18 with its free end disposed so as to strike drive arm 15, flange 19, and helical spring 20 running along rod 18, whereby upon impact of drive arm 15 the spring is compressed against a tube 21 which is solidly attached to frame 2 and serves to guide rod 18.

A ratchet system (not shown) normally holds striking lever 13 as an extension of oscillating lever 7, and releases it when arm 15 of lever 13 hits rod 18 of the elastic stop.

In order to propel an inflated ball 22, the electromagnetic coil 1 is supplied with a voltage proportional to the power of the blow desired. Plunger core 3 is drawn into coil 1 by electromagnetic force, with a speed which increases according to the progressive establishment of the current in the coil.

Since the current does not reach its nominal value instantaneously, the attraction force developed by electromagnet 1 increases gradually. It is important to take best advantage of this characteristic to transmit the maximum velocity to striking mass 17 at the instant of impact with ball 22.

When oscillating lever 7 nearly reaches the end of its excursion, drive arm 15 makes contact with rod 18 of the elastic stop and compresses spring 20, in particular transferring to it the kinetic energy of the system comprising plunger core 3, connecting rod 5, and oscillating lever 7, whereby the movement of this system is arrested. This energy is restored to a large extent by the expansion of spring 20, which repels drive arm 15 and re-accelerates the movement of striking arm 16. Striking mass 17 is not retarded by the elastic stop, and it continues its path whereby it pivots around articulation axle 14 until striking ball 22 which has been placed in a predetermined position for being propelled by elastic shock.

After the impact, a spring 23 which connects oscillating lever 7 to frame 2 returns it (lever 7) to its starting position.

Figure 4:
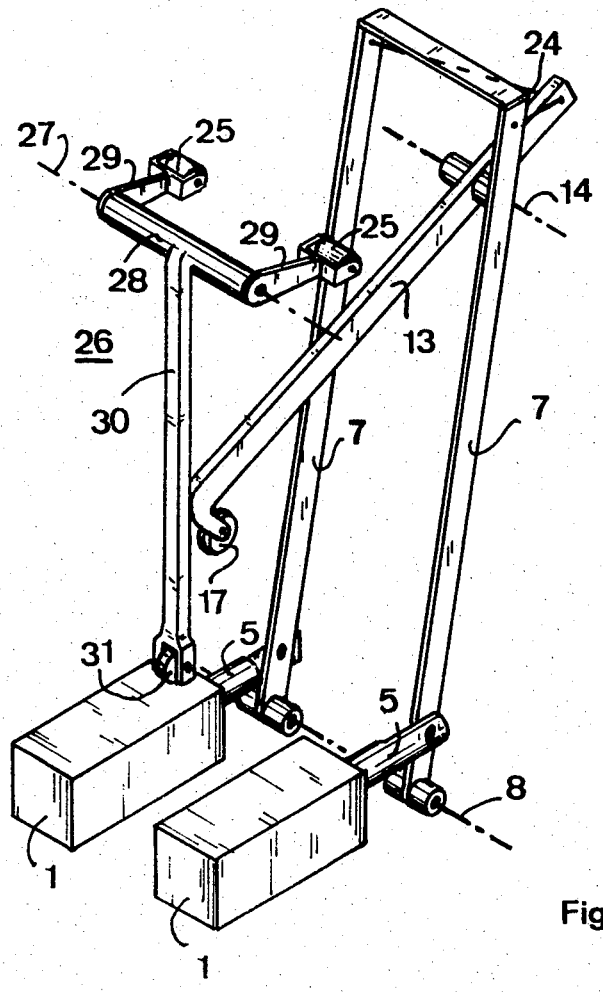
FIG. 4 is a perspective view of a fourth embodiment of a device according to the present invention.

FIG. 4 shows another arrangement, in which the oscillating lever is in the form of a two-lever assembly 7. Each lever 7 in the assembly pivots around an axle 8 and is moved by an electromagnet 1 via a plunger core 3 and a connecting rod 5. The link between the two levers 7 and the striking lever 13 pivoting around axle 14 parallel to axle 8 of lever 7 is provided by a flexible linkage 24 such a cable, a chain, or telescopic arms. In this arrangement an intermediate piece 26 oscillates around an axle 27 parallel to axles 8 and 14. Piece 26 comprises a cylinder 28 coaxial to axle 27, which cylinder bears a short arm 29 at each end, with rollers 25 mounted on the ends of said arms, and cylinder 28 is provided at its center with a longer arm 30 bearing a roller 31 on its end. When each oscillating lever 7 nearly reaches the end of its excursion, the end of each lever makes contact with the respective roller 25 of intermediate piece 26 which pivots around axle 27 and puts roller 31 in contact with striking levers 13. Intermediate piece 26 retards lever 7 and at the same time accelerates striking lever 13, transferring the kinetic energy of lever 7 to lever 13. The result is a higher speed of striking mass 17 when it contacts the ball.

Figure 5:
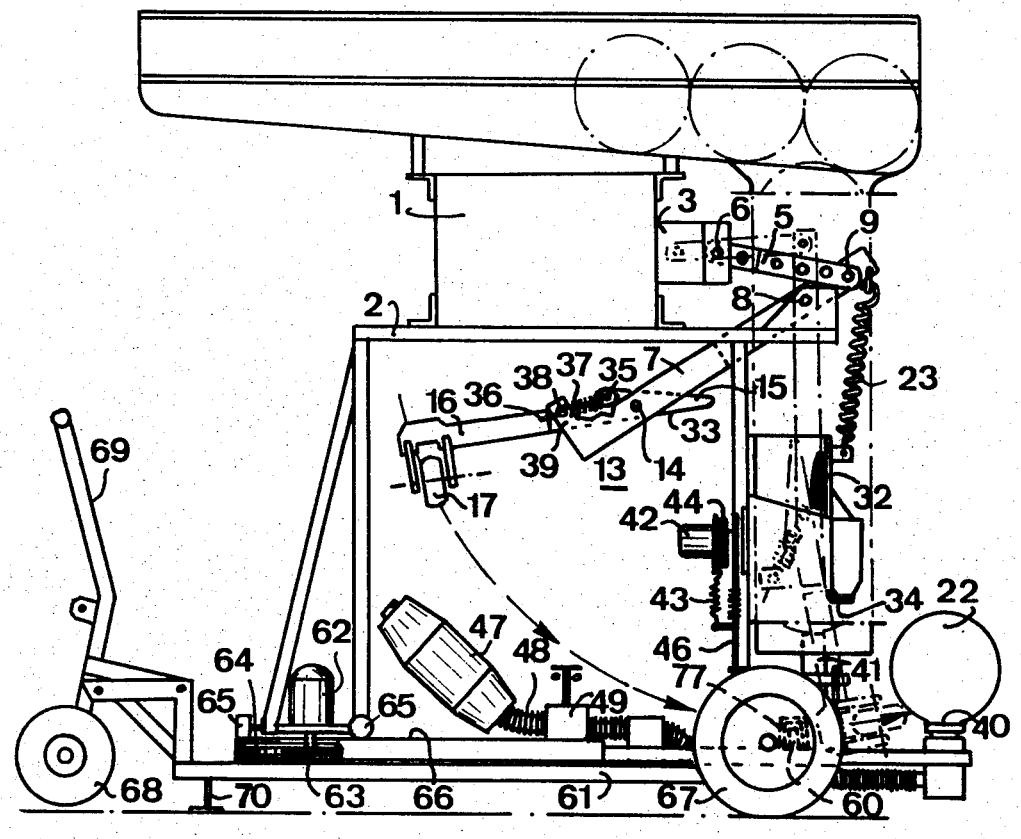
FIG. 5 is a side elevational view of a fifth embodiment of a device according to the present invention.

In still another example embodiment, shown in FIG. 5, frame 2 supports a stop 32 which is specially shaped to adapt the kinematics of the mechanism to the increasing attracting force of electromagnet 1 and suited to sustain the impact of an impact surface 33 which is solidly attached to drive arm 15.

It is especially necessary at the end of the excursion of plunger core 3 to simultaneously achieve, on the one hand, progressive acceleration of the striking arm 13, and on the other progressive release of oscillating lever 7. This is accomplished in the following manner in the present example of operation: When oscillating lever 7 nearly reaches the end of its excursion, impact surface 33 which is solidly attached to drive arm 15 comes into contact with shaped stop 32 at the farthest possible point from articulation axle 14, so that drive arm 15 is given the maximum effective length. As oscillating lever 7 moves in its excursion, the contact point between shaped stop 32 and impact surface 33 of drive arm 15 moves increasingly toward articulation axle 14. Striking arm 16 undergoes the same sort of angular displacement, continuously increasing, as that of oscillating lever 7; arm 16 is thereby continuously accelerated, giving striking mass 17 maximum speed at the time of impact with ball 22.

In this embodiment, striking mass 17 is completely free from rotation, so as not to oppose any rotational movement which has been imparted to inflated ball 22.

After impact with ball 22, striking arm 16 terminates its excursion against a detent 34.

Also shown in the embodiment of FIG. 5 is a device for aligning striking lever 13 with respect to oscillating lever 7 when the latter is in the raised position. This alignment device comprises an anchoring piece 35 solidly attached to striking lever 13, to which lever two rods are joined (36), each rod supporting a spring 37. The free end of each rod 36 slides in an end piece 38 which oscillates in a terminal piece 39 of oscillating lever 7 and serves as a stop for each spring 37.

Figure 6:
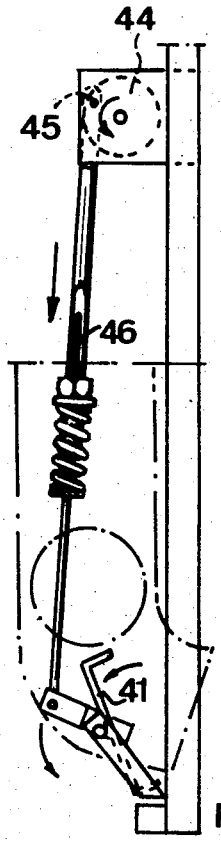
FIG. 6 is a side elevational view of a ball feeding mechanism which can be used with the device of FIG. 5.

The ball-propelling means is also furnished with a feed means, shown in FIGS. 5 and 6, intended to supply each ball to a cup 40 which exactly positions the ball to be propelled. This ball-feed device comprises an outlet piece 41 which is alternately driven by a motor 42 and a return spring 43 via a reduction gear 44, an eccentric 45, and a telescopic arm 46. At a first stage, under the action of electrical motor 42 the outlet piece 41 holds a ball in the ready position. At a second stage, under the action of return spring 43 the outlet piece 42 permits the ball to pass ahead to the positioning cup 40. This cup 40 has a diameter decidedly less than that of inflated ball 22 so as to avoid contact with the exterior edge of cup 40 of a sort which might cause modification of the trajectory of ball 22.

Figure 7:
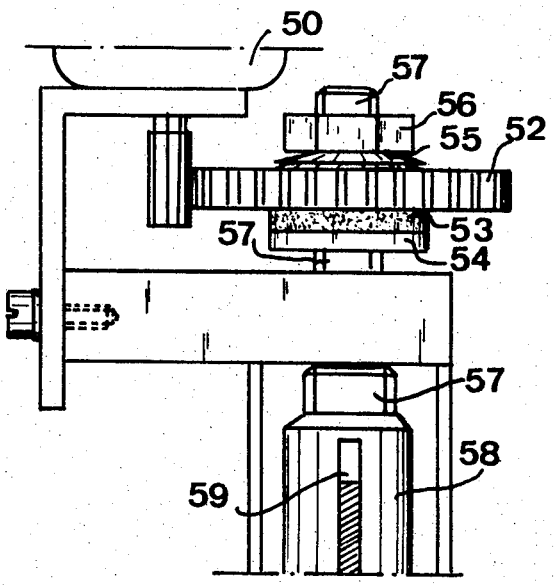
FIG. 7 is an altitude control device for the ball support of FIG. 5.

In view of the small diameter of positioning cup 40, the ball is held tightly and precisely on cup 40 by the provision of an aspiration means represented in FIG. 5. Positioning cup 40 is hollow and is connected to an aspirator 47 via a flexible tube 48 in which a vacuum relay 49 is inserted which indicates the presence of the ball on the cup and permits the ball to be struck as soon as it is correctly positioned. The altitude of cup 40 is controllable by a suitable device represented in FIG. 7.

This device comprises a drive motor 50 which is reversible and is provided with a drive pinion 51 which meshes with a gear 52 one face of which is supplied with a disc 53 made of a material with characteristic friction properties. Gear 52 and disc 53 are solidly joined and are applied against a metallic disc 54 with a pressure force exerted by a set of elastic washers 55 and controllable by a nut 56. The metallic disc 54 is solidly attached to a threaded rod 57 along which a piece 58 with an interior thread is displaced, piece 58 being solidly attached to an arm 59 which supports positioning cup 40. Disc 53 which is solidly attached to gear 52, and metallic disc 54 which is solidly attached to threaded rod 57, are held together with a certain pressure but may slide relative to each other if the firm couple is strained beyond an amount governed by the compression of elastic washers 55, in accordance with the position of screw 56 on the end of threaded rod 57. This arrangement acts as a limiter of the coupling, and takes over if and when threaded piece 58 reaches the end of its excursion on threaded rod 57.

In FIG. 5, frame 2 is a moveable part of the device for propelling an inflatable ball by elastic impact. Frame 2 pivots over a certain angle around an axle 60 which is solidly attached to a base structure 61. A bearing 77 is fit over axle 60, is solidly attached to frame 2, and is disposed ahead of frame 2, i.e. a little behind positioning cup 40. A reversible electric motor 62 equipped with a pinion 63 engages a rack 64 configured in a circular arc and solidly attached to base structure 61, for pivoting frame 2. Three wheels 65 disposed at the rear of frame 2 provide both stability and mobility. All of these wheels are oriented so as to roll on a track 66 disposed immediately above rack 64. A coupling limiter, not shown, intervenes in the manner described above, if and when pinion 63 reaches the end of rack 64. Base structure 61 is equipped with two supporting wheels 67 and two directing wheels 68 which are retractable by means of shaft 69, to rest base structure 61 on a foot 70. The lever arm relations of shaft 69 are devised so as to be able to easily carry out the setting down onto foot 70 and the employment of directing wheels 68. A single operator may thus maneuver the overall device without difficulty, in order to give it gross orientation and a stable base.

The above-described device for propelling an inflated ball by elastic impact may be powered by a battery, by a direct current source, or by an alternating current source through a rectifier.

In the case of storage battery powering, the batteries are preferably located in the propelling device or in immediate proximity thereto, due to the high current demand at the time of each stroke. Then cable of a large cross sectional area is needed in only a very short length. On the other hand, the batteries may be charged with a low-power source during off-time or in idle time during operation of the propelling device. If one wishes to avoid the encumbrance of the weight of batteries, or the maintenance which they require, an alternating current source may be used, with a rectifier. However, such an arrangement must be capable of furnishing direct current pulses of high intensity, which in turn requires equipment of large cross section. This is a serious handicap, since the propelling device is called upon to operate in sports fields, which are often distant from a current source.

Figure 8:
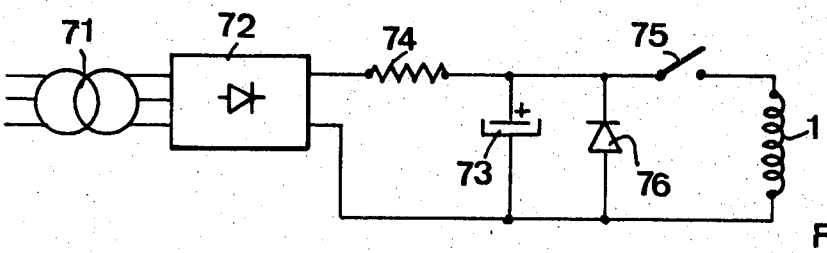
FIG. 8 is a schematic diagram showing control circuitry to be used with the device of FIG. 5.

Preferably, as represented in FIG. 8, the propelling device is equipped with a power supply comprising a rectifier 72 of relatively low capacity which feeds, through a limiting resistor 74, an electrolytic capacitor of sufficient capacitance to store a large part of the electrical energy needed to propel the inflated ball.

The rectifier and the limiting resistor 74 are sized so that the time between two successive strokes is longer than the time needed to charge capacitor 73.

With the aim of better exploiting this type of power supply, a transformer 71 adjusts the charge voltage of capacitor 73 to an optimum value to achieve a rapid rise of the current in electromagnet coil 1 when the signal for a stroke is given by closing switch 75.

A freewheeling diode 76 is connected in parallel with capacitor 73, to prevent the application of a voltage with opposite sign to the terminals of capacitor 73 during consecutive voltage oscillations during the discharge of the capacitor in the circuit comprising electromagnetic coil 1 and capacitor 73.

A device for propelling balls by elastic impact powered with such a power supply can be connected to a municipal electrical line by means of flexible cables of moderate cross section, which cables are easy to manipulate; even if these cables are very long such a connection may be advantageously made.

A voltage detector, not shown in FIG. 8, is inserted in the circuit of the battery of capacitors 73, so as to cut off the feed to transformer 71 as soon as the preset voltage is attained.

An auxiliary switch, not shown, is tripped at the same time as switch 75, to maintain the closure of switch 75 for a set time which is independent of the duration of the operator's pushing of the pushbutton on the control panel and which is chosen to guarantee coverage of the time necessary for the mechanical operations during the propelling and the time necessary for complete discharge of capacitor battery 73, such that switch 75 opens the circuit when there is no longer a current.

The device for propelling balls of elastic impact is controlled at a distance, by remote control equipment wherewith the control is collected in a single housing. The control housing contains:

- a pushbutton of the "punch" type to control immediate stoppage of the machine by completely cutting off its electrical supply;
- a sliding contact to control the power of the stroke;
- a pushbutton to initiate the stroke;
- a two-directional control of horizontally orient the mobile frame 2;
- a two-directional control to control the elevation of the positioning cup 40; and
- a two-directional sliding contact, with neutral position, to control the direction and speed of rotation of the positioning cup 40, where said cup is rotatable according to French Pat. App. EP 79200221.

When the operator pushes the pushbutton to initiate the stroke by closing switch 75, the battery of capacitors 73 is connected to the terminals of electromagnet 1. At the same time, the electric motor 42 actuates outlet piece 41 to place another ball in the ready position. Immediately after the propulsion of the first ball, the return spring 43 newly actuates outlet piece 41 to permit the ball which was placed in the ready position to move ahead to the positioning cup 40. Meanwhile, feed transformer 71 is connected to the terminals of rectifier 72 which supplies the battery of capacitors 73 through the intermediary of resistor 74. This supply of power is interrupted by the voltage detector as soon as the preset voltage corresponding to a particular stroke power is reached. At that instant the machine is ready for a new stroke.

I claim:

1. A device for the propulsion of balls by elastic impact, comprising:

- a frame;
- a ball support mounted to said frame;
- an oscillating lever pivotally mounted to said frame for movement through a first arc directed toward said ball support;
- a ball strike lever pivotally mounted directly to said oscillating lever for movement therewith through a second arc substantially coplanar with said first arc;
- a strike mass mounted on said strike lever for striking the ball positioned on said ball mount; and
- a means connected to said frame for causing said strike lever to move about said strike lever pivot mount after said oscillating lever has moved a limited distance through said first arc thereby giving a higher speed to said strike mass.

2. The device as set forth in claim 1, wherein said strike lever comprises a strike arm and a drive arm, said strike arm having a greater length than said drive arm, and wherein said means comprises a stop member mounted to said frame and positioned on said frame for abutting said drive arm.

3. The device as set forth in claim 2 and further including drive means connected to said frame and said oscillating lever for producing powered movement of said oscillating lever through said first arc.

4. The device as set forth in claim 3, wherein said drive means comprises at least one electromagnet, and a core plunger operatively associated with said electromagnet and connected to said oscillating lever.

5. The device as set forth in claim 2 and further including means for aligning said oscillating lever and said strike lever, said alignment means being connected between said oscillating lever and said strike lever.

6. The device as set forth in claim 5, wherein said alignment means comprises at least one rod having one end pivotally connected to one of said oscillating lever and said strike lever, an opposite end slidably connected to a pivot joint mounted on the other of said oscillating lever and said strike lever, and a spring connected between said rod pivot connection and said pivot joint.

7. The device as set forth in claim 2, wherein said stop member comprises a profiled surface whereby the point of contact of said stop member progresses along said strike arm in the direction of said strike lever pivotal mount.

8. The device as set forth in claim 7, wherein said ball support is positioned tangentially to said second arc, and further including suction means connected to said ball support for producing a suction force for holding a ball to said support.

9. The device as set forth in claim 8 and further including means for regulating the distance between said second arc and said ball support thereby aligning a ball mounted on said ball support with said strike mass.

10. The device as set forth in claim 9, wherein said regulating means comprises a reversible motor, a drive pinion driven by said reversible motor, a rack operatively engaging said drive pinion, a threaded rod rotated by said rack, an internally threaded member mounted on said threaded rod, and an arm formed integrally with said internally threaded member and connected to said ball support.

11. The device as set forth in claim 1 and further including means for supplying a ball to said ball support.

12. The device as set forth in claim 11, wherein said supply means comprises a release member, rotatable between a first position for holding a ball within a ball supply chute and a second position for releasing a ball onto said ball support.

13. The device as set forth in claim 1 and further including a base structure including two support wheels and a retractable guide wheel, said frame being pivotally mounted to said base structure, and further wherein said base structure includes a track, and said frame includes rollers rolling on said track and a reversible electric motor for rolling said rollers along said track.

* * * * *